US005334131A

United States Patent [19]

Omandam et al.

[11] Patent Number: 5,334,131

[45] Date of Patent: Aug. 2, 1994

[54] STRAP-ON MASSAGER WITH VIBRATORY UNBALANCED WEIGHT

[76] Inventors: Ismael C. Omandam, 439 Rebecca Rd., Belvidere, Ill. 61008; George Spector, 233 Broadway Rm 702, New York, N.Y. 10279

[21] Appl. No.: 109,247

[22] Filed: Aug. 20, 1993

[51] Int. Cl.[5] ..... A61H 1/00

[52] U.S. Cl. ..... 601/71; 601/70

[58] Field of Search ..... 128/32, 34, 35, 36, 128/58, 63

[56] References Cited

U.S. PATENT DOCUMENTS

| | | | |
|---|---|---|---|
| 2,742,036 | 4/1956 | Montesano | 128/36 |
| 3,710,784 | 1/1973 | Taylor | 128/32 |
| 3,896,795 | 7/1975 | Solhkhah | 128/36 |
| 4,055,169 | 10/1977 | Baker et al. | 128/36 |
| 4,343,303 | 8/1982 | Williams | 128/36 |
| 4,732,140 | 3/1988 | Stoffiegen | 128/36 |
| 4,887,594 | 12/1989 | Siegel | 128/36 |
| 4,979,502 | 12/1990 | Hunt | 128/32 |

FOREIGN PATENT DOCUMENTS

| | | | |
|---|---|---|---|
| 2090746 | 7/1982 | United Kingdom | 128/36 |

*Primary Examiner*—Robert A. Hafer
*Assistant Examiner*—Michael O'Neill

[57] ABSTRACT

A strap on massaging device is provided which consists of a padded housing with a vibrating mechanism retained within the padded housing. A pair of battery units for supplying a power source to the vibrating mechanism are retained within the padded housing. An elastic band extends from the padded housing to be attached about a leg of a person. The padded housing which is held to the leg will cushion against excessively vigorous uncomfortable effects of the vibrating mechanism acting against the leg.

1 Claim, 1 Drawing Sheet

STRAP-ON MASSAGER WITH VIBRATORY UNBALANCED WEIGHT

BACKGROUND OF THE INVENTION

The instant invention relates generally to vibrators and more specifically it relates to a strap on massaging device, which provides an elastic band that can be attached to a leg, so that is does not have to be hand held.

There are available various conventional vibrators which do not provide the novel improvements of the invention herein disclosed.

SUMMARY OF THE INVENTION

A primary object of the present invention is to provide a strap on massaging device that will overcome the shortcomings of the prior art devices.

Another object is to provide a strap on massaging device that can be attached about a leg of a person, so that the leg can be massaged directly without the need for the massaging device to be held by a hand.

An additional object is to provide a strap on massaging device in which a vibrating mechanism connected to a power source retained within a padded housing is held to the leg by an elastic band, so as to cushion against excessively vigorous uncomfortable effects of the vibrating mechanism acting against the leg.

A further object is to provide a strap on massaging device that is simple and easy to use.

A still further object is to provide a strap on massaging device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
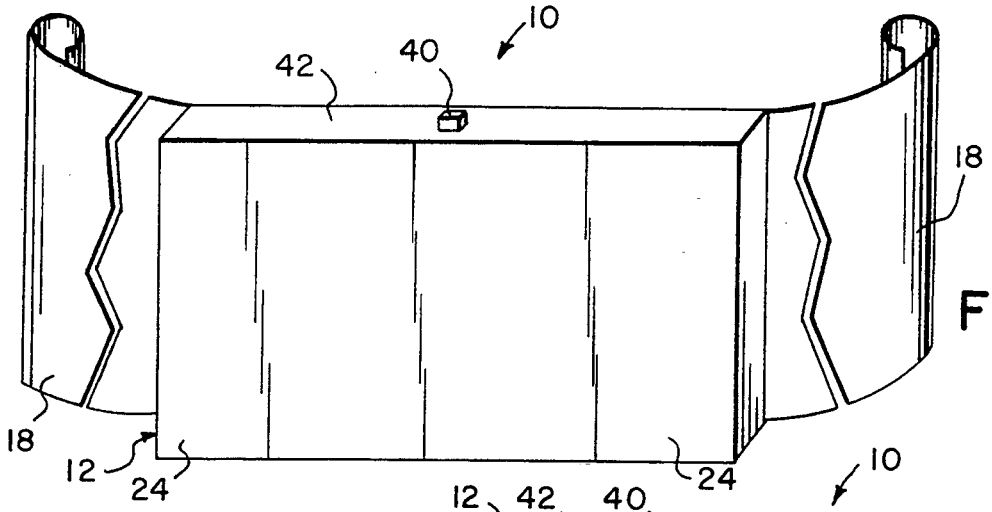
FIG. 1 is a front perspective view of the instant invention.
Figure 2:
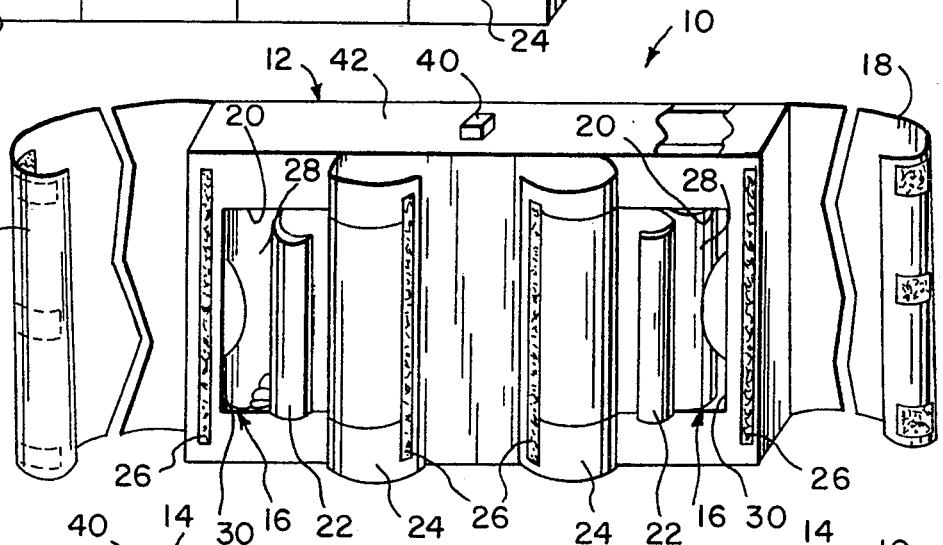
FIG. 2 is a front perspective view showing the front covers and the front flaps rolled back.
Figure 3:
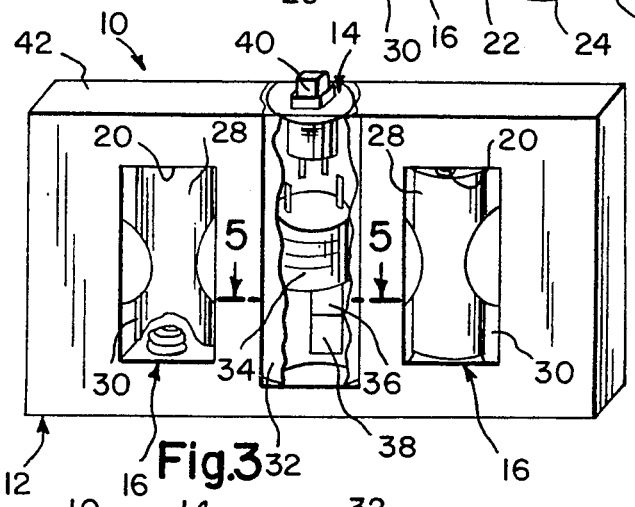
FIG. 3 is a front perspective view of the padded housing showing the battery holders and the cylinder tube broken away to see the motor, weight and switch therein.
Figure 4:
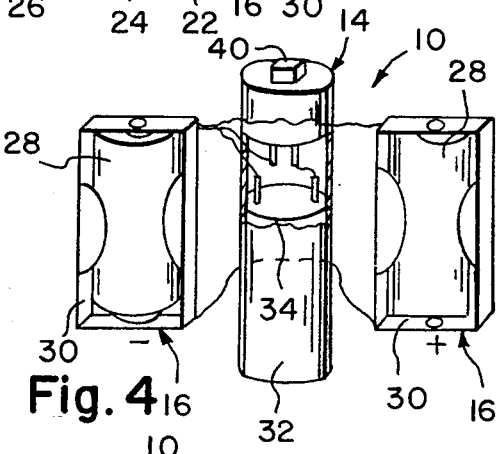
FIG. 4 is a perspective view of the battery holders and the cylinder tube broken away to see the electrical connection between the switch, motor and battery holders.

Turning now descriptively to the drawings, in which similar reference characters denote similar elements throughout the several views, FIGS. 1 through 6 illustrate a strap on massaging device 10, which consists of a padded housing 12 with a vibrating mechanism 14 retained within the padded housing 12. A pair of battery units 16 for supplying a power source to the vibrating mechanism 14 are retained within the padded housing 12. An elastic band 18 extends from the padded housing 12 to be attached about a leg of a person (not shown). The padded housing 12 which is held to the leg will cushion against excessively vigorous uncomfortable effects of the vibrating mechanism 14 acting against the leg.

The padded housing 12 has a pair of compartments 20, for holding the battery units 16 therein. A pair of front flaps 22 are over the compartments 20, while a pair of front covers 24 are over the front flaps 22. VELCRO fasteners 26 are for keeping the front covers 24 closed over the front flaps 22. Each battery unit 16 includes a battery 28 and a holder 30 for the battery 28, which fits into one compartment 20.

The vibrating mechanism 14 consists of a cylindrical tube 32 placed within the padded housing 12. A motor 34 is mounted in the cylindrical tube 32. A rotary shaft 36 extends from the motor 34. A weight 38 is offset on a distal end of the shaft 36 to cause vibrations. A switch 40 is mounted to the cylindrical tube 32 on an external side surface 42 of the padded housing 12, which is electrically connected between the motor 34 and the batteries 28.

Figure 5:
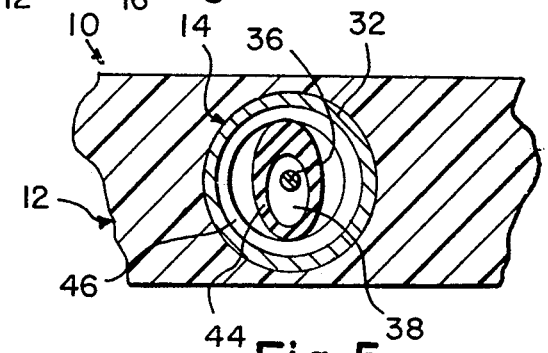
FIG. 5 is a cross sectional view taken along line 5—5 in FIG. 3 through the padded housing showing a modification wherein a cam weight and a rubber bumper is mounted on the motor shaft, which rotates about a bearing race to cause the vibration therein.
Figure 6:
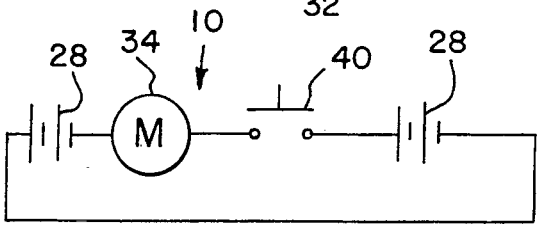
FIG. 6 is a schematic of the electrical circuit of the instant invention.

As shown in FIG. 5, the vibrating mechanism 14 further includes the weight 38 being cam shaped onto the distal end of the shaft 36. A rubber bumper 44 is mounted onto the cam weight 38. A bearing race 46 is in the cylindrical tube 32. The cam weight 38 with the rubber bumper 48 can rotate about the bearing race 46 to cause the vibration therein.

OPERATION OF THE INVENTION

To use the strap on massaging device 10, a person simply attaches the elastic band 18 about the leg. The switch 40 is then turned on to operate the motor 34 and rotate the shaft 36, causing the vibrations. To replace the batteries 28 the front covers 24 are opened to expose the front flaps 22 which are also opened. The batteries 28 are removed and replaced. The front flaps 22 are closed with the front covers 24 held closed by the VELCRO fasteners 26.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A strap on massaging device which comprises:

a) a padded housing;

b) a vibrating mechanism retained within said padded housing;

c) a pair of battery units for supplying a power source to said vibrating mechanism retained within said padded housing;

d) an elastic band extending from said padded housing to be attached about a leg of a person, so that said padded housing which is held to the leg will cushion against excessively vigorous uncomfortable effects of said vibrating mechanism acting against the leg;

e) said padded housing having a pair of compartments for holding said battery units therein;

f) a pair of front flaps over said compartments;

g) a pair of front covers over said front flaps;

h) VELCRO fasteners for keeping said front covers closed over said front flaps; wherein each said batter unit includes:

i) a battery;

j) a holder for said battery which fits into one said compartment; wherein said vibrating mechanism includes:

k) a cylindrical tube placed within said padded housing;

l) a motor mounted in said cylindrical tube;

m) a rotary shaft extending from said motor;

n) a weight offset on a distal end of said shaft to cause vibrations;

o) a switch mounted to said cylindrical tube on an external side surface of said padded housing which is electrically connected between said motor and said batteries; wherein said vibrating mechanism further includes:

p) said weight being cam shaped onto the distal end of said shaft;

q) a rubber bumper mounted onto said cam weight; and r) a bearing race in said cylindrical tube, so that said cam weight with said rubber bumper can rotate about said bearing race to cause the vibration therein.

* * * * *